US006956549B2

(12) United States Patent
Naiki

(10) Patent No.: US 6,956,549 B2
(45) Date of Patent: Oct. 18, 2005

(54) LCD DRIVER

(75) Inventor: Takashi Naiki, Kyoto (JP)

(73) Assignee: Rohm Co., LTD, Kyoto (JP)

( * ) Notice: Subject to any disclaimer, the term of this patent is extended or adjusted under 35 U.S.C. 154(b) by 284 days.

(21) Appl. No.: 10/299,508

(22) Filed: Nov. 19, 2002

(65) Prior Publication Data

US 2003/0107541 A1 Jun. 12, 2003

(30) Foreign Application Priority Data

Dec. 7, 2001 (JP) ..... 2001-373624

(51) Int. Cl.[7] ..... G09G 3/36

(52) U.S. Cl. ..... 345/87; 345/94; 345/98; 345/204; 345/690

(58) Field of Search ..... 345/87, 94, 98, 345/204, 211, 690; 368/678; 348/687

(56) References Cited

U.S. PATENT DOCUMENTS 3,806,709 A * 4/1974 Fitch et al. ..... 377/28
4,215,430 A * 7/1980 Johnson, Jr. ..... 375/362
4,369,462 A * 1/1983 Tomizawa et al. ..... 380/235
4,743,096 A * 5/1988 Wakai et al. ..... 345/89
5,317,401 A * 5/1994 Dupont et al. ..... 348/678
5,552,926 A * 9/1996 Owa et al. ..... 359/326
2002/0068603 A1 * 6/2002 Ito et al. ..... 455/550

FOREIGN PATENT DOCUMENTS

JP 06-351084 * 12/1994

* cited by examiner

*Primary Examiner*—Vijay Shankar
*Assistant Examiner*—Leonid Shapiro
(74) *Attorney, Agent, or Firm*—Hogan & Hartson LLP

(57) ABSTRACT

An LCD driver compares an image signal with a count of a counter repeatedly counting a clock. Based on the result of the comparison, the LCD driver outputs pulses each having a duty factor in accord with the image signal. When the count is not between first and second predetermined numbers, the frequency of the clock supplied to the counter is switched from a fundamental frequency to a low-frequency, thereby controlling the width of a drive voltage of a liquid crystal display cell and correcting the image signal in association with the S-shape characteristic of optical transmittance of the liquid crystal display cell. This LCD driver is advantageously simple in structure.

9 Claims, 5 Drawing Sheets

LCD DRIVER

FIELD OF THE INVENTION

The invention relates to a liquid crystal display (LCD) driver for providing a drive voltage corrected by pulse-width modulation (PWM) in accord with an image signal.

BACKGROUND OF THE INVENTION

LCDs are commonly used as means for displaying images. The optical transmittance of a liquid crystal depends on the voltage applied to it. This property is utilized in an LCD to control the luminance of a liquid crystal by controlling the voltage applied to it to thereby control the amount of light emitted from a source of light and passing through the liquid crystal.

The optical transmittance of liquid crystal is not a linear function of the applied voltage. A typical TN-type or STN-type liquid crystal has a substantially linear optical transmittance only in the intermediate region of its operating voltage and has slowly varying nonlinear transmittance above and below the linear region, as shown in FIG. 1. Thus, an overall optical transmittance of a liquid crystal has an S-shape distribution (referred to as S-shape characteristic of optical transmittance).

A conventional LCD driver converts a given image signal into a pulse-width modulated drive voltage using a pulse-width modulation (PWM) voltage generator. The conversion involves a correction that modifies the converted voltage such that an apparent linear optical transmittance is obtained, that is, the S-shape optical transmittance is compensated for in accord with the image signal.

FIG. 2 is a block diagram of a conventional PWM voltage generator for use with an LCD drive. A display memory 41 stores image signals to be displayed on the LCD. The stored data may be output in sequence from the memory 41.

A palette circuit 42 has a lookup table for converting, for example, 4-bit (16-gray level) data into 5-bit (32-gray level) data. The converted data is clocked out from the palette circuit 42 in sequence. The palette circuit 42 is a programmable circuit composed of, for example, electrically erasable programmable ROMs (EEPROMs), configured to make above mentioned correction to the S-shape characteristic of the LCD.

A decoder 43 is supplied with a clock clk and the output of the palette circuit 42, and supplies a PWM control signal to a PWM circuit 44. The clock clk has a higher frequency than required in clocking 4-bit data, so that the palette circuit 42 can convert 4-bit data into 5-bit data.

The PWM circuit 44 executes pulse-width modulation of the clock under the control of a PWM control signal received from the decoder 43 and in accordance with the image signal received from the display memory 41, and periodically outputs pulse-width modulated signals OUT. The periodic signal OUT is supplied to the LCD as the drive voltage therefor.

In this way, the image signal received from the display memory 41 is corrected based on the S-shape characteristic of the LCD to provide luminance of a liquid crystal that is visually consistent with the image signal.

However, in order to raise the resolution of an image, the conventional PWM voltage generator steps up the frequency of a fundamental clock to a higher frequency prior to selecting a clock adequate for the image signal. Hence, the conventional PWM voltage generator requires a palette circuit as discussed above, which circuit disadvantageously increases complexity of the LCD driver, contrarily to a need for simplification of the driver.

SUMMARY OF THE INVENTION

The invention takes an advantage of the fact that liquid crystals have an S-shape voltage-optical transmittance characteristic in correcting the image signal based on the S-shape characteristic. As a result of the correction of the image signal, the invention provides apparent correction of the S-shape characteristic (the correction giving an apparent linear optical transmittance characteristic). This can be done by performing pulse wave modulation on the drive voltage such that the clock frequency (clock speed) of the drive voltage is switched based on the pulse count of a counter. The correction can be attained by a structurally simplified LCD driver.

An LCD driver in accordance with one embodiment of the invention comprises;

a counter for counting input clocks, the counter adapted to return to its initial state to repeat counting of input clocks as the count has reached a specified number;

at least one comparator for comparing the count received from the counter and each image signal received, the comparator generating a sequence of pulses each having a prescribed duty factor in accordance with the magnitude of the image signal;

a clock generator for generating at least one kind of clock having a frequency lower than the fundamental frequency of a fundamental clock, the clock generator adapted to select either one of the fundamental clock and said at least one lower-frequency clock to provide the counter with the selected clock as the input clock; and a clock-switching instruction circuit for providing the clock generator with a selection signal that instructs the clock generator to select:

the lower-frequency clock while the count of the counter does not exceed a first preset number after said counter started with a given initial number;

the fundamental clock while the count exceeds the first preset number but does not exceed a second preset number; and the lower frequency clock when the count exceeds the second preset number.

In an LCD driver according to the invention, the visual luminance of the LCD can be corrected in accord with a given image signal without any palette circuit for converting the input image signal itself. Thus the driver circuit has a simple structure.

It should be appreciated that a low-frequency clock is used when the count of the counter lies in a near-lower limit domain and a near-upper limit domain of the image signal so that the width of one step of the PWM is larger in these domains to compensate for the nonlinearity of the S-shape transmittance characteristic.

DETAILED DESCRIPTION OF THE PREFERRED EMBODIMENT

Figure 3:
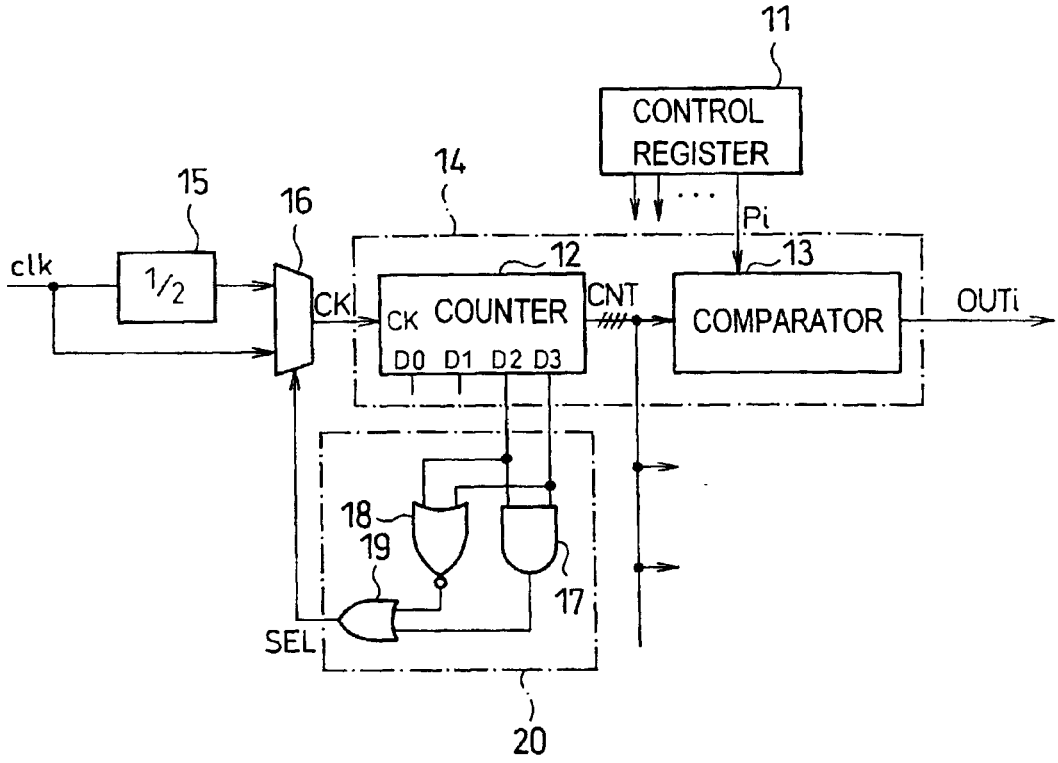
FIG. 3 is a block diagram of an LCD driver according to the invention.
Figure 4:
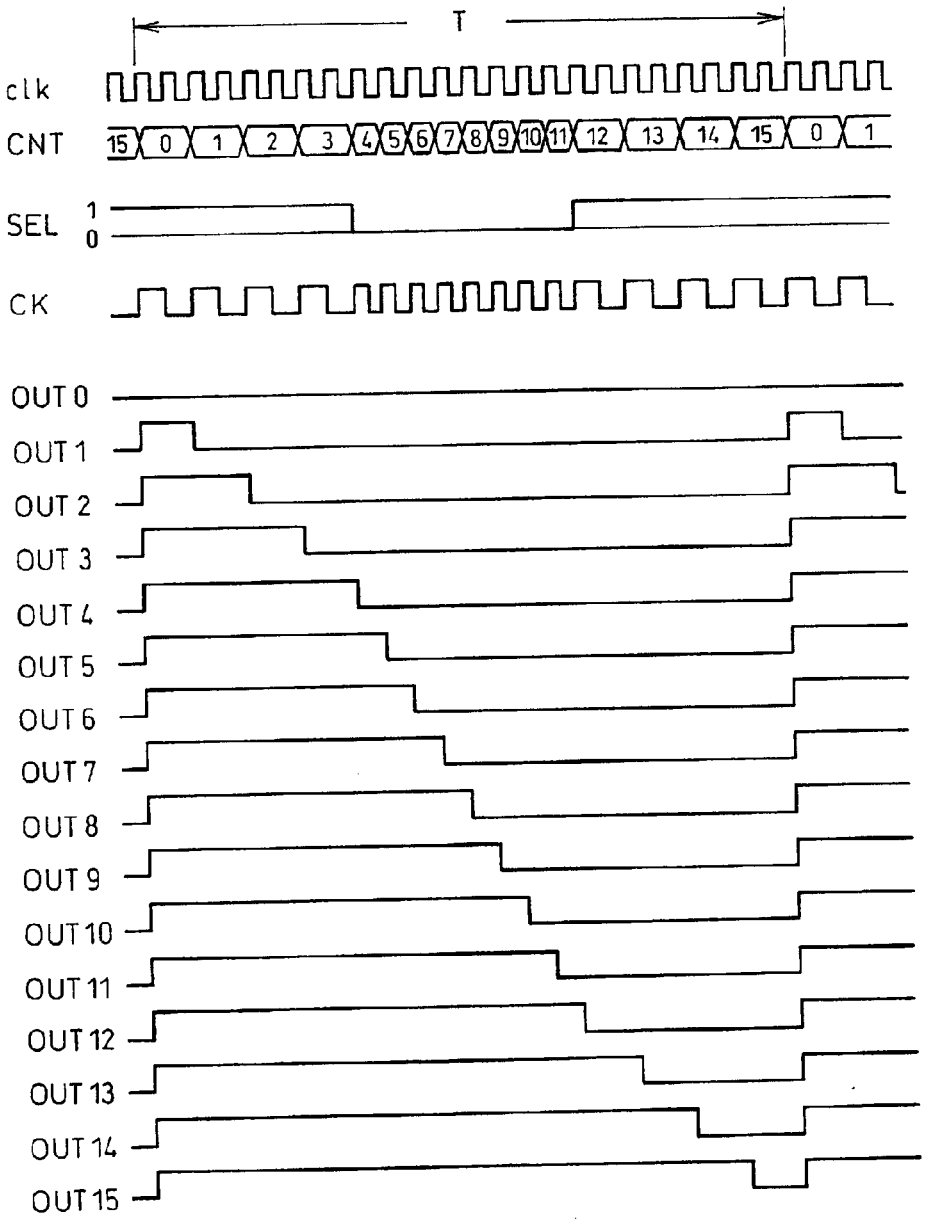
FIG. 4 is a timing diagram of the LCD driver of FIG. 3.
Figure 5:
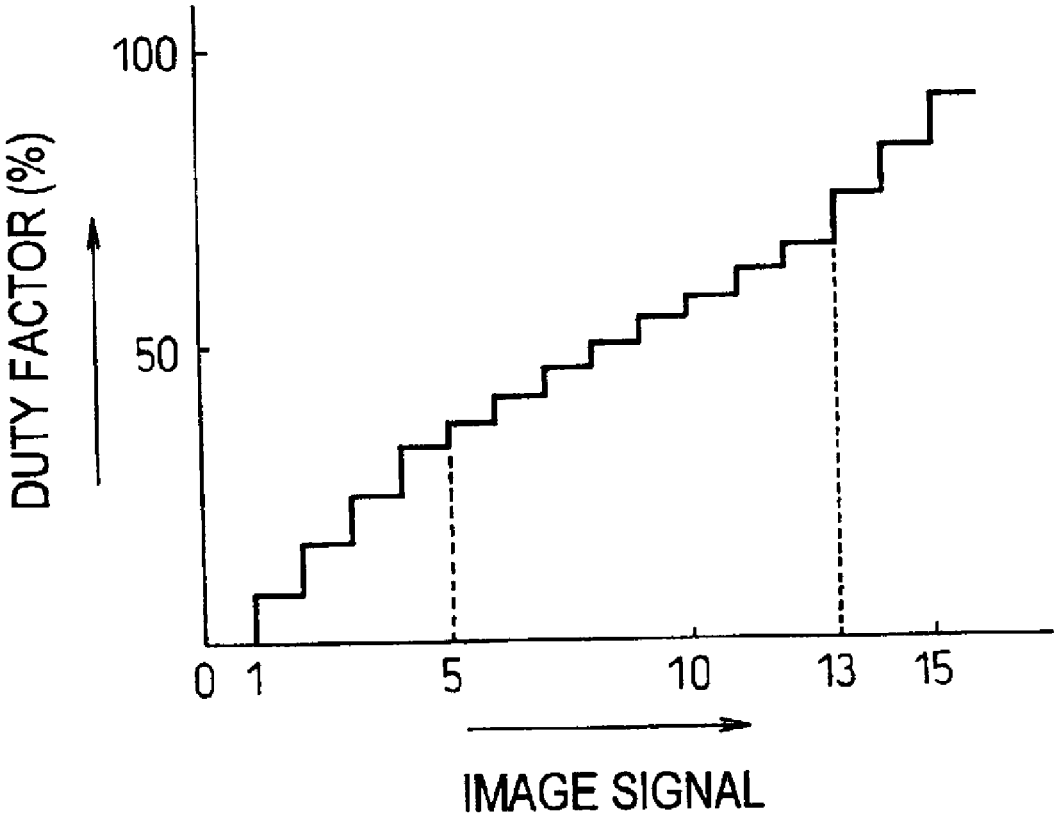
FIG. 5 shows a relationship between duty factors of PWM and the magnitude of an input signal.

FIG. 3 is a block diagram of an LCD driver according to one embodiment of the invention. FIG. 4 is a timing diagram of the LCD driver. FIG. 5 shows a relationship between duty factors of PWM and the magnitude of an input signal.

As shown in FIG. 3, a control register 11 stores the image signals Pi to be displayed on an LCD, in the form of digital data (referred to as digital image data). The control register 11 sequentially updates and outputs digital image data (or digital image signals) Pi. The control register 11 is configured to output in parallel a multiplicity of image signals Pi to be displayed simultaneously on the LCD.

A PWM circuit 14 receives an input clock CK and the image signals Pi, and outputs a PWM signal for each of the image signals. In order to deal with the multiple image signals Pi simultaneously, the PWM circuit 14 has a counter 12 and the same number of parallel comparators 13 as the number of signals Pi. It is noted that the counter 12 is commonly used by the comparators 13.

The counter 12 is a binary-coded hexadecimal counter. In the example shown herein, the counter 12 counts the input clocks CK and periodically outputs a count CNT (0–15) in 4 bits (D0–3). It should be understood, however, that the counter may have another arrangement to generate a count CNT, in an arbitrary number of bits.

The image signals Pi and the count CNT are supplied to the respective comparators 13. The comparators 13 are adapted to generate a high output voltage when the count CNT exceeds the maximum count of 15 and is reset to the initial value of 0. An image signal Pi is compared with the count CNT in the respective comparator 13, and if the count CNT is less than the magnitude of the image signal Pi, the high voltage is generated, but if the count CNT equals or exceeds the magnitude of the image signal Pi, a low voltage (0 volt) output is generated.

Thus, as a result of the comparison, a periodic pulse-width modulated pulse, referred to as comparison output OUTi, having a width that depends on the magnitude of the image signal Pi is generated by the respective comparator 13. Alternatively, each of the comparators 13 may be configured to generate the high voltage output while the count CNT does not exceed the magnitude of the image signal Pi.

The comparison outputs OUTi are supplied to the respective liquid crystal display cells as their drive voltages indicative of the image signals Pi.

A frequency divider 15 has a frequency-division factor of 2, implying that the divider divides the frequency of the fundamental clock clk by 2 to generate a low-frequency clock. (Such frequency divider will be referred to as double-division frequency divider, and the resultant frequency as double-division frequency.) The low-frequency clock is supplied, together with the fundamental clock, to a clock selector 16. The frequency divider 15 and the clock selector 16 together constitute a clock generator.

The clock selector 16 selects either the fundamental clock clk or the low-frequency clock as instructed by a clock-switching instruction signal SEL, and outputs the selected clock as the input clock CK to the counter 12.

A clock-switching instruction circuit 20 has an AND circuit 17 receiving a third output of the terminal D2, and a NOR circuit 18 receiving a fourth output terminal D3 of the counter 12. The clock-switching instruction circuit 20 further has an OR circuit 19 for coupling the outputs of the AND circuit 17 and the NOR circuit 18 to form a clock-switching instruction signal SEL.

The clock-switching instruction signal SEL is output when signals are provided at both of the third and the fourth output terminals D2 and D3, respectively and when no signal is provided at both terminals. That is, the signal is output when the count CNT is in the ranges of 0–3 and 12–15. This implies that input clocks of different frequencies are selected symmetrically with respect to the mean value of the count CNT, in association with the count CNT.

Referring to FIGS. 4 and 5, operations of the LCD driver will now be described.

The operational period T of the PWM equals the period of the counter 12 counting from 0 to 15 in the example shown. The low-frequency clock is selected as the input clock CK when the count CNT is in the range 0–3. The fundamental clock is selected as the input clock CK when the count CNT is in the range 4–11. The low-frequency clock is again selected when the count is in the range 12–15. In this way, clocks of different frequencies as determined by the count CNT are supplied to the counter 12. This implies that the period of one clock varies with the count CNT.

The image signals Pi are compared with the count CNT in the respective comparators 13. When the image signal Pi is larger than the count CNT, the high voltage is output from the comparator 13, but otherwise the low-voltage is output. Hence, the PWM results in a controlled comparison output OUTi associated with respective image signals Pi. It will be noted that the period of one clock is longer in the initial stages 0–3 and in the final stages 12–15 of the period T than in the intermediate stages 4–11 of the period T (FIG. 4). Thus, the width of the comparison output OUTi, i.e. drive voltage, associated with the magnitude Pi becomes non-linear.

This nonlinearity can be seen in FIG. 4. Of the comparator outputs OUT0–OUT15 associated with the magnitudes of image signal Pi (i=0–15), the comparator outputs OUT0–OUT4 and OUT13–15 have a large step, while the comparator outputs OUT5–OUT12 have a smaller modulation step.

Figure 1:
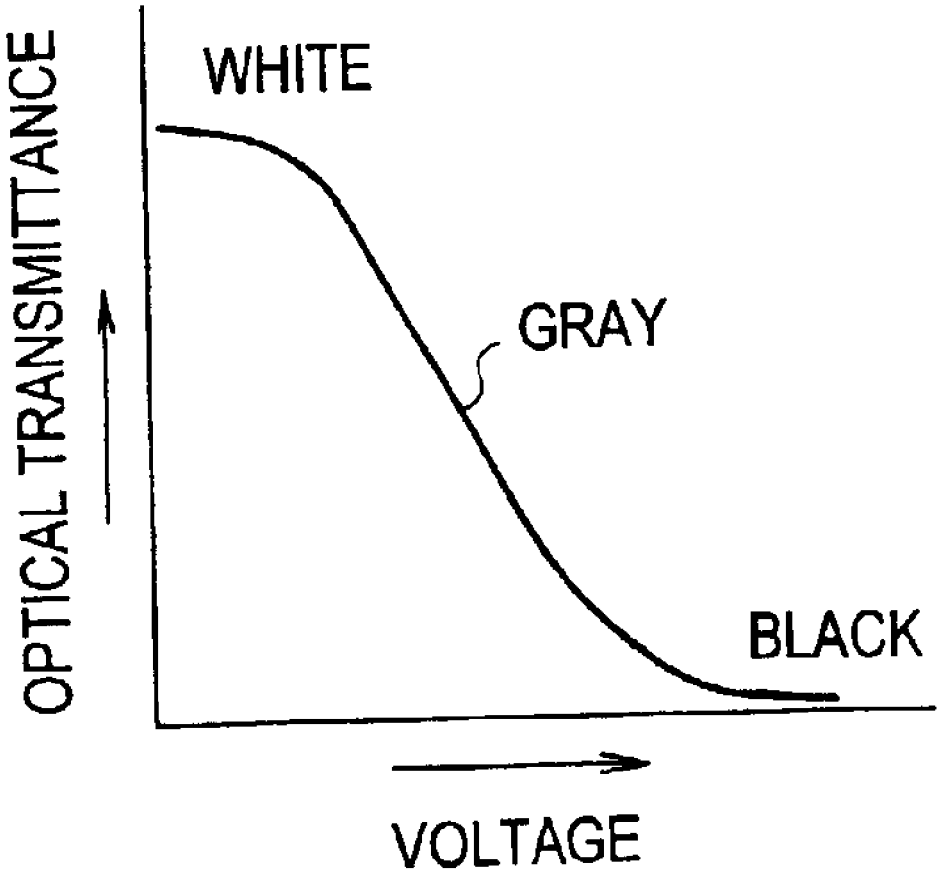
FIG. 1 shows optical transmittance of an LCD as a function of the applied voltage.
Figure 2:
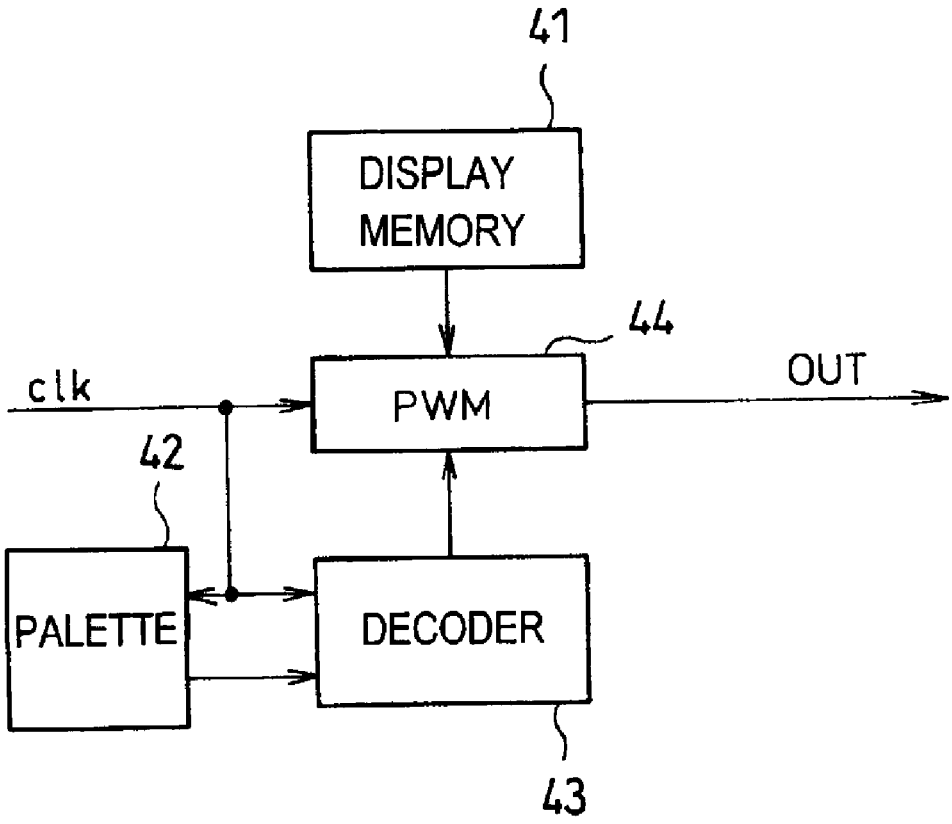
FIG. 2 PRIOR ART
FIG. 2 is a block diagram of a conventional LCD driver.

FIG. 5 shows PWM duty factor as a function of the magnitude of image signal Pi. As seen in FIG. 5, an increment of PWM duty factor is larger in the small ranges (0–4) and in the large ranges (13–15) of image signal Pi as compared with an increment in the intermediate ranges (5–12). This characteristic variation in PWM duty factor results in corresponding characteristic variation in the drive voltage, which in turn results in a correction to the S-shape characteristic of optical transmittance of the liquid crystal display cells shown in FIG. 1. Accordingly, the visual luminance of the LCD can be set in accord with the image signal.

Various modifications can be made in the embodiment described and shown above.

The count CNT obtained by counting the clock CK is output from the counter 12 with a period of T independently of the operations of the control register 11 and the comparators 13. Thus, by extending the 4-bit bus line, the count CNT may be utilized simultaneously by a multiplicity of comparators performing similar processing of multiple input signals, so that the count CNT may be utilized as it is by the multiple comparators and multiple image signals.

In most cases where the LCD uses a multiplicity of identical liquid crystal display cells, a single set of the counter 12, clock switching circuit 20, frequency divider 15, and clock selector 16 can be used in common for the correction to the S-shape characteristics of multiple liquid display cells, thereby simplifying the overall structure of the driver.

The clock-switching instruction circuit 20 consisting of an AND circuit 17, a NOR circuit 18, and an OR circuit 19 as shown in FIG. 3 may be replaced by programmable means that facilitates determination of the counts of the counter 12 at which the clock selector 16 can switch clocks for better correction to the S-shape characteristic of liquid crystal display cells.

The invention may be practiced by any clock-switching instruction circuit so long as it is capable of determining the counts CNT to switch on and off the clock-switching instruction signal SEL. Thus, if the programmable means is used to determine the count CNT, the LCD driver can be simplified as compared with conventional ones.

A more precise PWM control may be carried out based on the count of the counter 12 by employing a higher order frequency divider or dividers capable of frequency-dividing the fundamental clock clk with frequency division factors of 3, 4, etc., along with a suitable clock selector.

As an example, clocks may be varied in one period T by including those clocks having a quadruple-division frequency (frequencies), a double-division frequency (frequencies), a fundamental frequency, a double-division frequency (frequencies), and a quadruple-division frequency (frequencies), arranged in the order mentioned, and by switching over from one to the next in association with the S-shape characteristic of the LCD cells.

As another example, instead of symmetric clock switching (e.g. switching of the respective clocks in the sequence of 4, 4, 2, 2, 1, 1, 1, 1, 1, 1, 1, 1, 2, 2, 4, 4, where each number stands for a duration of 1 clock), asymmetric clock switching (e.g. 4, 4, 4, 2, 2, 1, 1, 1, 1, 1, 1, 1, 2, 2, 4, 4) may be employed in accordance with an asymmetric S-shape characteristic of the optical transmittance of the display cells.

In addition, the slowness of the clock selected at the first count of 0 may be set slower than, for example, that for the last count of 15 (that is, duration of the first stage for which the count is 0 may be set longer than the duration of the last stage for which the count is 15). This will compensate a drop in the average output power of the PWM driver caused by a delay (or slowdown) of the rise of the first output pulse.

What we claim is:

1. An LCD driver, comprising:

a counter for counting input clocks for each image signal received, said counter adapted to return to the initial state thereof to repeat said counting as the count of said counter has reached a specified number;

at least one comparator for comparing said count received from said counter and each image signal received, said comparator generating a sequence of pulses each having a prescribed duty factor in accordance with the magnitude of said image signal;

a clock generator for generating at least one kind of clock having a frequency lower than the fundamental frequency of a fundamental clock, the clock generator adapted to select either one of said fundamental clock and said at least one kind of lower-frequency clock to provide said counter with the selected clock as said input clock; and a clock-switching instruction circuit for providing said clock generator with a selection signal that instructs said clock generator to select:

said lower-frequency clock while said count of said counter does not exceed a first preset number after said counter started with a given initial number;

said fundamental clock while said count exceeds said first preset number but does not exceed a second preset number; and said lower frequency clock when said count exceeds said second preset number.

2. The LCD driver according to claim 1, wherein said counter is a binary counter; and said clock-switching instruction circuit is a logic circuit adapted to construct said selection signal in accordance with the output of said binary counter.

3. The LCD driver according to claim 2, wherein said binary counter is a binary-coded hexadecimal counter having first through fourth output terminals; and said logic circuit is adapted to construct said selection signal based on the signals received from said third and fourth output terminals of said binary-coded hexadecimal counter.

4. The LCD driver according to claim 1, wherein said clock generator includes:

a frequency divider for dividing said fundamental clock to generate said lower-frequency clock; and a selector for selecting, as the output of said clock selector, either said fundamental clock or said lower-frequency clock of said frequency divider in response to said selection signal.

5. The LCD driver according to claim 4, wherein said frequency divider has a frequency-division factor of 2.

6. The LCD driver according to claim 4, wherein said frequency divider generates N different lower frequency clocks (N being an integer greater than 1) by frequency-dividing the fundamental clock; and said selector sequentially selects said fundamental clock and said N different lower frequency clocks in the order of increasing frequency, and then in the order of decreasing frequency.

7. The LCD driver according to claim 6, wherein said frequency dividers respectively have a frequency-division factor of 2 and 4.

8. The LCD driver according to claim 6, wherein said selector is adapted to select clocks of different frequencies such that the distribution of clock frequencies is symmetrical in the first and the second half of said period.

9. The LCD driver according to claim 6, wherein said selector is adapted to select clocks of different frequencies such that the distribution of clock frequencies is asymmetrical in the first and the second half of said period.

* * * * *